United States Patent [19]

Wickersham

[11] Patent Number: 4,871,102

[45] Date of Patent: Oct. 3, 1989

[54] SKI RETAINING DEVICE

[76] Inventor: John M. Wickersham, 1905 Spruce Wood, Daytona, Fla. 32014

[21] Appl. No.: 269,726

[22] Filed: Nov. 9, 1988

[51] Int. Cl.[4] ..... A63C 11/00

[52] U.S. Cl. ..... 224/191; 294/147; 280/814; 224/917; 224/265; 224/267

[58] Field of Search ..... 224/191, 151, 201, 235, 224/267, 270, 917, 907, 265, 266, 247, 222, 261; 211/70.5, 60.1; 294/141, 143, 147, 165; 280/814; 24/3 R, 3 A, 3 L

[56] References Cited

U.S. PATENT DOCUMENTS

| | | | |
|---|---|---|---|
| 3,259,284 | 7/1966 | Olson | 294/142 |
| 3,421,725 | 1/1966 | Glass | 248/304 |
| 3,570,681 | 3/1971 | Kinshofer | 211/70.5 |
| 3,626,553 | 12/1971 | Darney et al. | 280/814 |
| 3,893,606 | 7/1985 | Hofmann | 224/309 |
| 3,936,067 | 2/1976 | Link | 280/814 |
| 3,947,927 | 4/1976 | Rosenthal | 24/306 |
| 3,994,048 | 11/1976 | Rosenthal | 24/306 |
| 4,002,277 | 1/1977 | Westerholm | 294/147 |
| 4,002,349 | 1/1977 | Dopp | 280/814 |
| 4,010,961 | 3/1977 | Goode | 280/814 |
| 4,015,762 | 4/1977 | Mendillo | 294/149 |
| 4,047,726 | 9/1977 | Kokeisl | 280/814 |
| 4,114,838 | 9/1978 | Knauf | 294/157 |
| 4,120,437 | 10/1978 | Hara | 280/814 |
| 4,131,289 | 12/1978 | Maller | 280/814 |
| 4,134,182 | 1/1979 | Ramsby | 280/814 |
| 4,141,565 | 2/1979 | Shields | 280/814 |
| 4,165,027 | 8/1979 | Briggs | 294/147 |
| 4,190,182 | 2/1980 | Hickey | 294/147 |
| 4,234,113 | 11/1980 | Nalvarian | 294/142 |
| 4,261,493 | 4/1981 | Newman | 224/257 |
| 4,294,387 | 10/1981 | Wnek | 224/315 |
| 4,456,284 | 6/1984 | Saka | 280/812 |
| 4,470,528 | 9/1984 | Dyess | 224/257 |
| 4,630,842 | 12/1986 | Roda | 280/814 |
| 4,681,246 | 7/1987 | Andersson | 224/267 |
| 4,699,415 | 10/1987 | Skovajsa | 294/147 |

*Primary Examiner*—Henry J. Recla
*Assistant Examiner*—Glenn T. Barrett
*Attorney, Agent, or Firm*—Lockwood, Alex, FitzGibbon & Cummings

[57] ABSTRACT

A ski retaining device is provided for carrying a pair of skis on a user's shoulder. A U-shaped nesting portion is provided for holding a pair of skis therein and the retaining device is provided with straddle portions to comfortably balance the device on the user's shoulder. The nesting portion includes locking clip portions which are dimensioned to frictionally engage and securely hold the skis therein. In a second embodiment, a retaining strap is provided to give the nesting portion added rigidity while retaining a pair of skis therein. The disclosed embodiments are provided with securing straps which enable the user to secure the retaining device to his or her ankle while skiing.

17 Claims, 2 Drawing Sheets

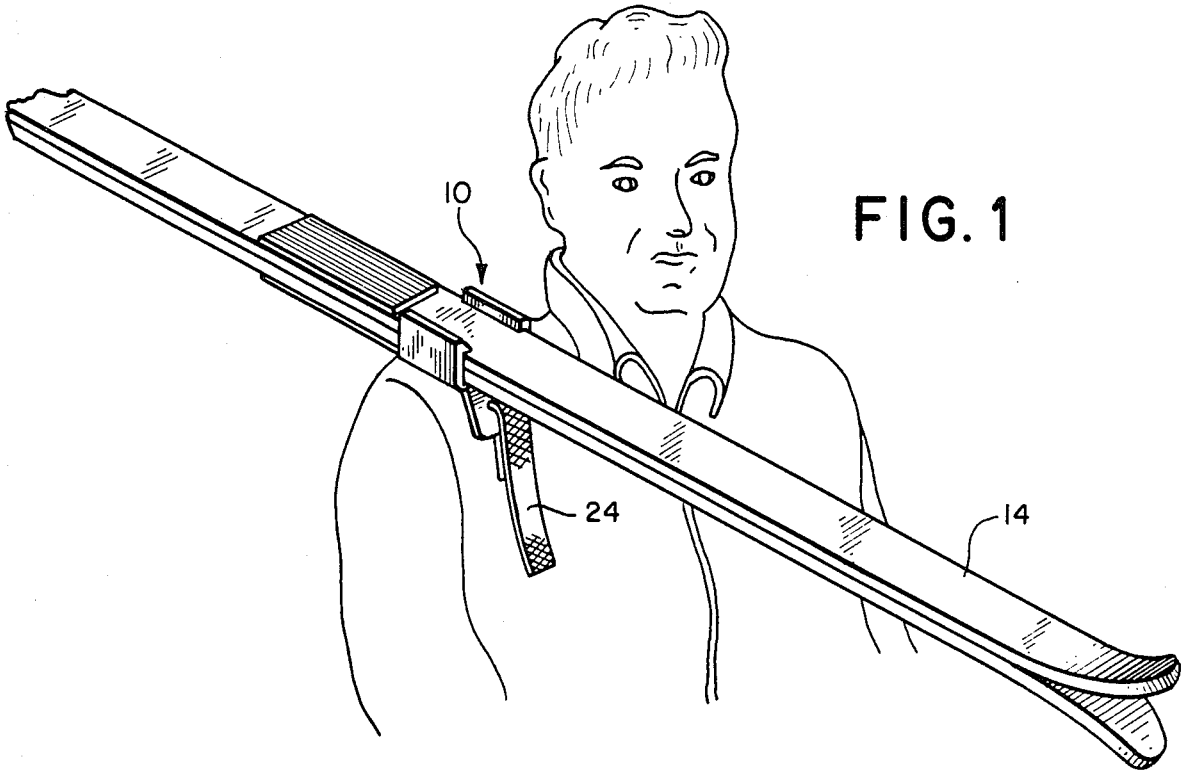
FIG. 1
FIG. 2
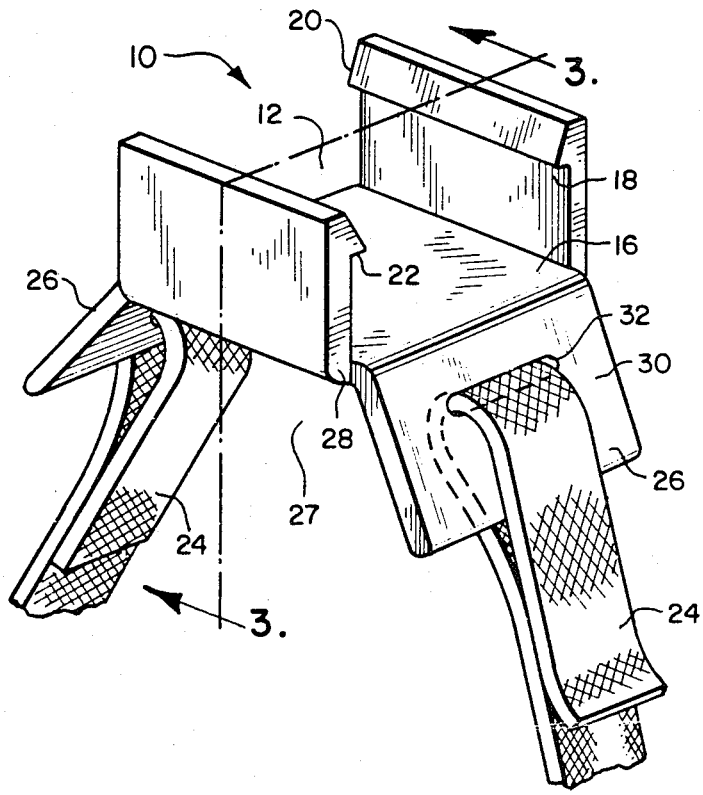
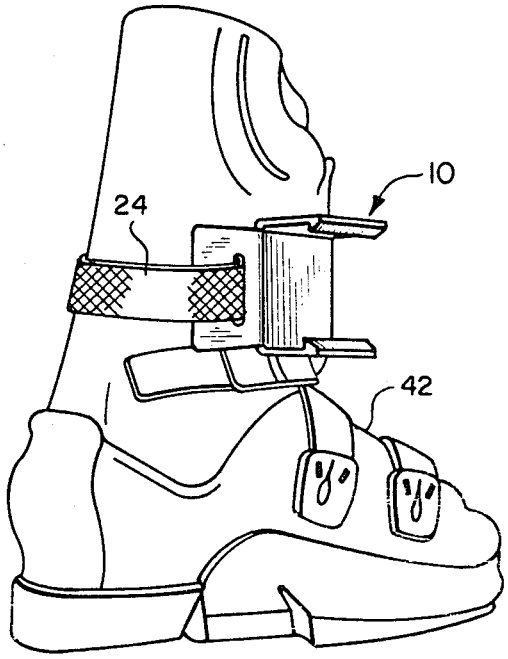
FIG. 7

FIG. 3
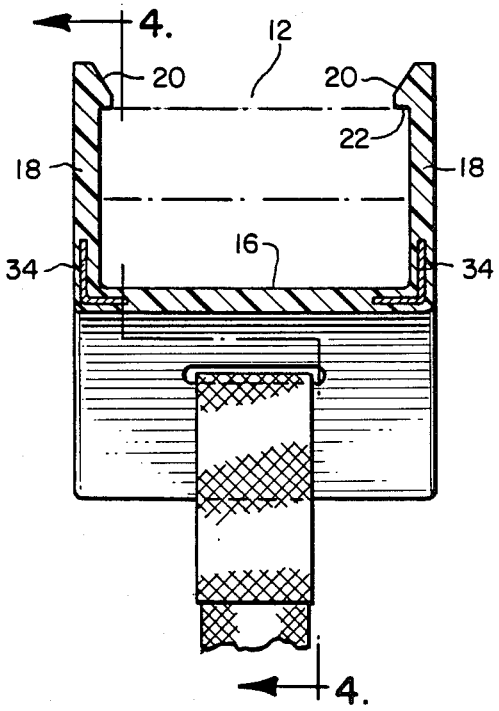
FIG. 4
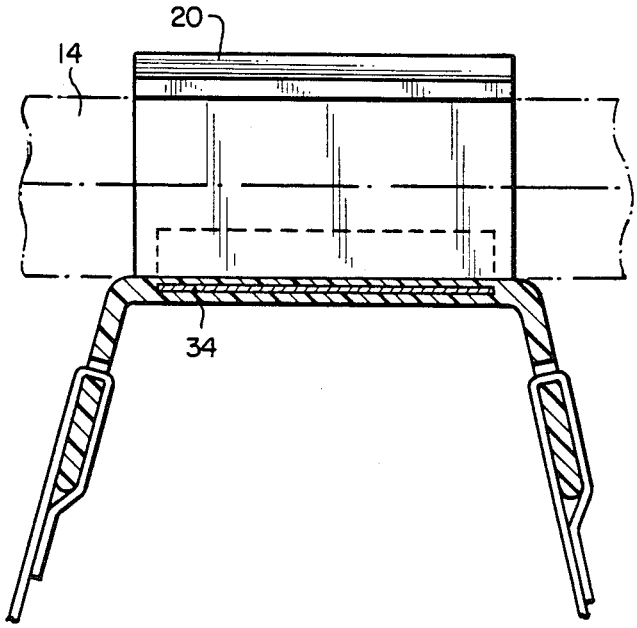
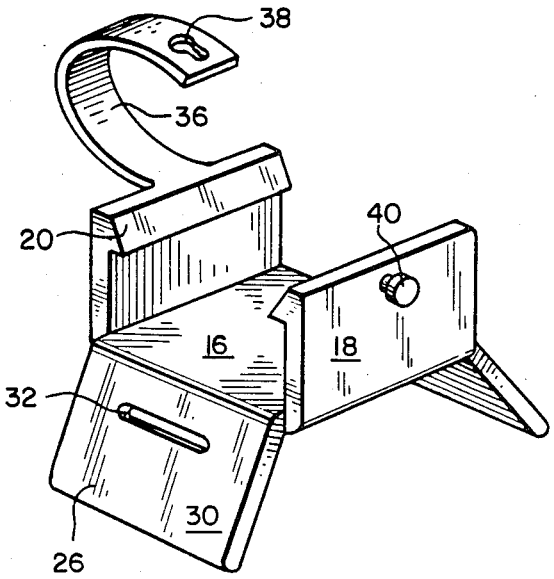
FIG. 5
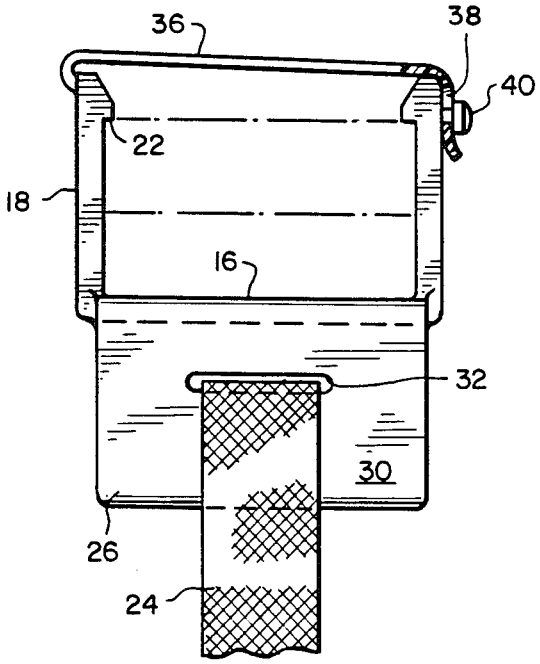
FIG. 6

SKI RETAINING DEVICE

BACKGROUND AND SUMMARY OF THE INVENTION

This invention generally relates to devices for carrying a pair of skis. More specifically, invention relates to a device that can be balanced on user's shoulder for carrying a pair of skis therein so that skis are comfortably supported by the user's shoulder while being releasably retained within the device. In the disclosed embodiments, the device may be releasably and conveniently secured to the user's ankle for storage thereof while user is skiing.

Various devices for carrying skis and related equipment are known. While the prior art generally discloses such devices, the art does not disclose a lightweight and compact device which will releasably and firmly retain a pair of skis to allow the user to comfortably balance the skis on one of the user's shoulders, and which can be strapped around the user's ankle for storage thereof while is the user skiing.

The present invention overcomes the limitations of the prior art. The ski retaining device of the present invention provides a means for comfortably balancing a pair of skis on a user's shoulder. In the described embodiments, a U-shaped nesting portion is provided for holding a pair of skis therein. Locking clip portions are provided along the ends of the U-shaped nesting portion to releasably secure the skis therein. In a second embodiment, a retaining strap is also provided to span the open end of the nesting portion and to hold the skis more securely therein. The retaining device is dimensioned to rest comfortably on the user's shoulder and a securing strap is provided to releasably secure the device to the user's ankle or ski boot for convenient storage of the device while the user is skiing.

In use, the skis are inserted within the nesting portion and will rest on the user's shoulder and extend transversely across the user's collar bone. In the preferred embodiment, the device is manufactured with a lightweight and flexible material.

It is accordingly an object of the present invention to provide a ski retaining device for comfortably and conveniently carrying a pair of skis.

It is another object of the present invention to provide a ski retaining device which is dimensioned to rest comfortably on the user's shoulder.

BRIEF DESCRIPTION OF THE DRAWINGS

These and other objects and advantages of the present invention will be appreciated by those skilled in the art upon consideration of the remainder of the disclosure including the detailed description of the invention and the drawings, wherein:

FIG. 1 is a perspective view of one embodiment of a ski retaining device according to the present invention, showing the device positioned on a user's shoulder with a pair of skis retained therein;

FIG. 2 is an enlarged perspective view of the device of FIG. 1;

FIG. 3 is an elevational view, in cross-section, of the ski retaining device of FIG. 2 taken along the 3—3 line thereof;

FIG. 4 is an elevational view, in cross-section, of the ski retaining device of FIG. 3 taken along the 4—4 line thereof;

FIG. 5 is a perspective view of a second embodiment of the ski retaining device of the present invention;

FIG. 6 is an elevational view of the embodiment of FIG. 5;

FIG. 7 is a view showing the ski retaining device of FIG. 1–4 in a storage position on a user's ski boot.

DETAILED DESCRIPTION OF THE INVENTION

Referring to FIGS. 1 and 2, illustration is made of a ski retaining device 10, according to the present invention. The device 10 is dimensioned to comfortably rest on the shoulder of a user. Support means in the form of a nesting portion 12 are provided to receive a pair of skis 14 therein. The nesting portion 12 includes support floor 16 which rests on the user's shoulder in a substantially horizontal position. A pair of parallel vertically extending wall portions 18 extend from the support floor 16 in a perpendicular manner to form a three dimensional U-shaped area. Preferably, the distance between the wall portions 18 substantially corresponds to the standard width of a conventional snow ski. Locking clips 20 extend inwardly from the unattached edge of each of the vertically extending walls 18. The nesting portion 12 is manufactured so that the distance between locking clip portions 20 is less than the distance between the two vertically extending wall portions 18. Each clip portion 20 includes a retaining ledge 22 which is positioned away from the support floor 16 at a distance which corresponds to the combined thickness of a pair of skis 14. As shown in FIG. 1, the clip portions 20 hold the skis 14 within the nesting portion 12 via frictional contact between the skis and the retaining ledge 22. In the preferred embodiment, the depth of the nesting portion 12 will provide enough area to allow the user to easily balance the skis 14 on the user's shoulder by supporting the skis with one arm.

At least two straddle portions 26 are provided to balance the nesting portion 12 on the user's shoulder. As shown, straddle portions 26 extend down from the support floor 16 at an obtuse angle as measured from the side edges 28 of the vertically extending wall portions 18 down to the upper face 30 of the straddle portion 26. A mounting area 27 is formed between the straddle portions 26 for receiving the user's should therein. Strap attachment means are provided in the form of elongate strap receiving holes 32 extending through each straddle portion 26 for receiving a securing strap 24 therethrough. As shown in FIG. 7, the securing strap 24 holds the device 10 in a storage position on the user's ankle while the user is skiing. The strap 24 may be of a conventional design and is secured to the straddle portions 26 in a manner generally known in the art. Similarly, means for tightening the strap around the user's ankle are provided.

Referring now to FIG. 3, illustration is made, in cross-section, of the nesting portion 12. As already mentioned, the nesting portion 12 is dimensioned to snugly but reversibly retain a pair of skis 14 therein. Therefore, the width of nesting portion 12, as measured by the distance between the vertically extending wall portions 18, will typically correspond to the width of the skis 14. The locking clip portions 20 are positioned within the nesting portion 12 so that the distance between retaining ledge 22 and the support floor 16 accommodates the combined thickness of a pair of skis 14 when stacked bottom to bottom, as shown in FIG. 1. In this manner, the skis 14 are held snugly within the nesting portion 12 so that the user may use one arm to easily balance the skis on his or her shoulder. When the nesting portion 12 is dimensioned properly, the retaining ledge 22 abuts against a surface of one of the skis 14 to provide a frictional retaining force to securely hold the skis 14 therein.

As shown in FIGS. 3 and 4, metallic inserts 34 may be provided at the juncture between the support floor 16 and the vertically extending wall portions 18. The inserts 34 provide added rigidity to the nesting portion 12. Such added rigidity is especially useful when the device 10 is manufactured out of certain synthetic materials such as Silicone based materials, for example.

Referring to FIGS. 5 and 6, a second embodiment of the ski retaining device of the present invention is shown. Except as otherwise discussed, the structure, function, and operation of the device of FIGS. 5 and 6 is identical to that of the embodiment depicted in FIGS. 1 through 4 and will not be repeated. Like numerals are used to identify like elements. The device shown in FIGS. 5 and 6 is provided with a flexible retaining strap 36 which extends from the top of one of the vertically extending wall portions 18. The free end of the strap 36 is provided with a hole 38 therethrough. Retaining knob 40 is positioned on the outer face of a vertically extending wall portion 18. With this arrangement, the retaining strap 36 may be extended across the opened end of the U-shaped nesting portion 12 and attached to the retaining knob 40 by inserting the knob through the hole 38. When fully extended, the retaining strap 36 is substantially parallel with the support floor 16, as depicted in FIG. 6. In this manner, the retaining strap 36 holds the skis 14 within the nesting portion 12 more securely by maintaining the vertically extending walls 18 in a more rigid spacial relationship. The use of the retaining strap 36 may be important when the device 10 is manufactured out of certain synthetic materials.

As shown in FIG. 7, the device 10 may be strapped to the user's ski boot 42 by positioning the ankle of the ski boot 42 in the mounting area 27 and affixing the device 10 to the boot 42 with securing straps 24. In this manner, the user may keep the device 10 strapped to his or her boot 42 to conveniently store the device while skiing. When needed, the user may simply remove the device from his or her ankle and reposition it on one of the user's shoulders for transporting a pair of skis from one area to another such as from one ski area to another ski area, for example. When the user arrives at an alternate ski area, the skis may be removed from the device 10 and reattached around the ankle of the boot 42.

Regarding materials and methods of manufacturing, the ski retaining device of the present invention can be made out of a variety of materials and according to various methods, as known by those skilled in the art. Injection molding, rotational molding and casting are all acceptable methods for manufacturing the device. Satisfactory materials include polypropylene, polyurethanes and other urethane containing materials. Preferably, the device is manufactured with silicone materials or materials which remain soft and flexible when exposed to a wide range of temperatures.

While the embodiments of the present invention have been described and disclosed above, it will be understood that variations to the present invention may be made by those skilled in the art without departing from the true spirit and scope of the present invention, as defined in the following claims.

What is claimed is:

1. A ski retaining device, comprising:

a nesting portion dimensioned to releasably hold a pair of skis therein;

straddle portions affixed to and extending from said nesting portion;

said straddle portions forming a mounting area therebetween for positioning said nesting portion alternatively, on a person's shoulder or ankle wherein said straddle portions are oriented with the respect to said nesting portion such that said skis, when held in said nesting portion, would extend transverse to the shoulder of a person when said straddle portions are positioned on said person's shoulder and;

a securing strap operatively associated with said straddle portions for reversibly affixing said nesting portion to a person's ankle for storing said device while skiing.

2. The ski retaining device of claim 1, wherein said nesting portion includes a support floor and a pair of parallel wall portions, each of said wall portions being affixed to and extending from an edge of said support floor to form a three dimensional U shaped structure for retaining a pair of skis therein.

3. The device of claim 2, wherein each of said wall portions further includes a locking clip portion, each locking clip portion having a retaining ledge, said retaining ledge being positioned parallel to said support floor and spaced from said support floor to maintain a pair of skis between said support floor and said retaining ledge.

4. The device of claim 3, wherein said nesting portion further includes a flexible retaining strap and a retaining knob, said strap extending from an edge of one of said wall portions and said retaining knob being positioned on a face of the other said wall portion, said strap including a hole extending through the free end thereof to receive said knob when said strap is positioned over said support floor to thereby maintain said wall portions in a preferred spacial relationship for retaining a pair of skis within said nesting portion.

5. The device of claim 2, wherein the distance between said wall portions substantially corresponds to the width of a ski.

6. The device of claim 3, wherein the distance between said locking clip portions is less than the distance between said parallel wall portions.

7. The device of claim 3, wherein the locking clip portions are positioned within said nesting portion and at a distance from said floor portion which substantially corresponds to the combined thickness of a pair of skis.

8. The device of claim 6, wherein said retaining ledge abuts against the surface of one of said skis to frictionally retain said skis within said nesting portion.

9. The device of claim 1, wherein said ski retaining device is manufactured with a material from the group consisting of urethanes, polyurethanes, polypropylene, silicone-containing materials and mixtures thereof.

10. A ski retaining device, comprising:

a nesting portion dimensioned to releasably hold a pair of skis therein, said nesting portion including a support floor and a pair of parallel wall portions, each of said wall portions being affixed to and extending from an edge of said support floor;

straddle portions affixed to and extending from said nesting portion;

said straddle portions forming a mounting area therebetween for positioning said nesting portion, alternatively, on a person's shoulder or ankle wherein said straddle portions are oriented with respect to said nesting portion such that said skis, when held in said nesting portion, would extend transverse to the shoulder of a person when said straddle portions are positioned on said person's shoulder ; and a securing strap operatively associating with said straddle portions for reversibly affixing said nesting portion to a person's ankle for staring said device while skiing.

11. The device of claim 10, wherein each of said wall portion's further includes a locking clip portion, each locking clip portion having a retaining ledge, said ledge being positioned parallel to said support floor and spaced from said support floor to maintain a pair of skis between said support floor and said retaining ledge.

12. The device of claim 11, wherein said nesting portion further includes a flexible retaining strap and a retaining knob, said strap extending from an edge of one of said wall portions and said retaining knob being positioned on a face of the other said wall portion, said strap including a hole extending through the free end thereof to receive said knob when said strap is positioned over said support floor to thereby maintain said wall portions in a preferred spacial relationship for maintaining a pair of skis within said nesting portion.

13. The device of claim 10, wherein the distance between said wall portions substantially correspond to the width of a ski.

14. The device of claim 11, wherein the distance between said locking clip portions is less than the distance between said parallel wall portions.

15. The device of claim 11, wherein said locking clip portions are positioned within said nesting portion and at a distance from said floor portion which substantially corresponds to the combined thickness of a pair of skis.

16. The device of claim 11, wherein said retaining ledge abuts against he surface of one of said skis to frictionally retain said skis within said nesting portion.

17. The device of claim 10, wherein said ski retaining device is manufactured with a material from the group consisting of urethanes, polyurethanes, polypropylene, silicone-containing materials and mixtures thereof.

* * * * *